US005251437A

United States Patent [19]

Furuya

[11] Patent Number: 5,251,437

[45] Date of Patent: Oct. 12, 1993

[54] METHOD AND SYSTEM FOR CONTROLLING AIR/FUEL RATIO FOR INTERNAL COMBUSTION ENGINE

[75] Inventor: Junichi Furuya, Isesaki, Japan

[73] Assignee: Japan Electronic Control Systems Co., Ltd., Isesaki, Japan

[21] Appl. No.: 849,085

[22] PCT Filed: Sep. 4, 1991

[86] PCT No.: PCT/JP91/01184

§ 371 Date: May 1, 1992

§ 102(e) Date: May 1, 1992

[87] PCT Pub. No.: WO92/04538

PCT Pub. Date: Mar. 19, 1992

[30] Foreign Application Priority Data

Sep. 4, 1990 [JP] Japan ..... 2-232494

[51] Int. Cl.[5] ..... F01N 3/20

[52] U.S. Cl. ..... 60/274; 60/276; 60/285; 123/674; 123/691

[58] Field of Search ..... 60/274, 276, 285; 123/674, 691

[56] References Cited

U.S. PATENT DOCUMENTS 4,715,344 12/1987 Tomisawa ..... 123/674
4,796,425 1/1989 Nagai et al. ..... 60/274
4,800,857 1/1989 Tomisawa ..... 123/674
5,077,970 1/1992 Hamburg ..... 60/277

FOREIGN PATENT DOCUMENTS 58-48756 3/1983 Japan .
60-240840 11/1985 Japan .
62-70641 4/1987 Japan .
63-97851 4/1988 Japan .
63-179155 7/1988 Japan .
1-285635 11/1989 Japan .

*Primary Examiner*—Douglas Hart
*Attorney, Agent, or Firm*—Foley & Lardner

[57] ABSTRACT

An air/fuel ratio control method and system for an internal combustion engine employing first and second air/fuel ratio sensors, respectively upstream and downstream of a catalytic converter, sets and stores learnt correction values, by learning through an averaging process, for an air/fuel ratio correction value by a second air/fuel ratio sensor, stores a degree of progress of learning with respect to each learning, and modifies the learnt correction value with a modification ratio depending upon the degree of progress of learning. Accordingly, both a promotion of the learning and an enhancement of the accuracy of the learning can be achieved, and thus the emission control performance can be improved by progressively reducing an offset at the transition from an inactive state to an active state of the air/fuel ratio feedback control or at the transition of an engine driving range.

8 Claims, 10 Drawing Sheets

METHOD AND SYSTEM FOR CONTROLLING AIR/FUEL RATIO FOR INTERNAL COMBUSTION ENGINE

BACKGROUND OF THE INVENTION

1. Field of the Invention

The present invention relates to an air/fuel ratio control for an internal combustion engine. More particularly, the invention relates to a method and system for feedback control of an air/fuel ratio with high precision, on the basis of detected values of two air/fuel ratio sensors.

2. Description of the Related Art

A typical air/fuel ratio control system for an internal combustion engine, in the prior art, is disclosed in Japanese Unexamined Patent Publication No. 60-240840.

In brief, the system disclosed in the above-identified publication detects an intake air flow rate Q and an engine speed N, calculates a basic fuel supply amount Tp ($=K \cdot Q/N$; K is constant) corresponding to an amount of air introduced into an engine cylinder, corrects the basic fuel supply amount Tp with correction factors, such as engine temperature and so forth, further performs a feedback correction using an air/fuel ratio correction coefficient (air/fuel ratio correction amount) set by a signal from an air/fuel ratio sensor (oxygen sensor), which detects air/fuel ratio of a mixture by detecting oxygen concentration in an exhaust gas, and performs a correction based on a battery voltage and so forth to thus set a final fuel supply amount TI.

Then, by outputting a drive pulse signal having a pulse width corresponding to the set fuel supply amount TI, to a fuel injection valve, a predetermined amount of fuel is injected to the engine.

The air/fuel ratio feedback correction based on the signal from the air/fuel ratio sensor is performed so as to control the air/fuel ratio to be near a target air/fuel ratio (stoichiometric air/fuel ratio). This is because an emission control catalyst device (catalytic converter) disposed in an exhaust system for oxidation of CO and HC (hydrocarbon) in the exhaust gas and for reducing NOx is set to operate with an optimal converting efficiency (purification efficiency) at the exhaust gas condition corresponding to combustion of the stoichiometric air/fuel ratio mixture.

The air/fuel ratio sensor is provided to swiftly vary a generated electromotive force (output voltage) in the vicinity of the stoichiometric air/fuel ratio. Therefore, by comparing the output voltage $V_0$ with a reference voltage (threshold level) corresponding to the stoichiometric air/fuel ratio, a judgement can be made whether the air/fuel ratio of the mixture is rich or lean. For example, when the air/fuel ratio is lean (rich), the relatively large proportional component P of the air/fuel ratio feedback correction coefficient $\alpha$, which is to be multiplied by the basic fuel supply amount Tp, is increased (decreased) at the initial cycle after switching the air/fuel ratio to lean (rich), and is subsequently increased (decreased) by a given integral component I at every cycle to control the air/fuel ratio to be near the target air/fuel ratio (stoichiometric air/fuel ratio). It should be noted that there are some air/fuel ratio control systems which neglect the proportional component and set the air/fuel ratio feedback correction coefficient $\alpha$ by an integration control.

In the above-mentioned normal air/fuel ratio feedback control system, the air/fuel ratio sensor is located at the convergent section of the exhaust manifold close to the combustion chamber, to obtain higher response characteristics with a single air/fuel ratio sensor, but since the exhaust gas temperature at this portion is high, it affects the air/fuel ratio sensor to thus cause a variation of the sensor characteristics due to thermal influence or fatigue. Furthermore, the mixture of the exhaust gas from each engine cylinder is insufficient and makes it difficult to detect an average air/fuel ratio over all of the engine cylinders, and thus makes the precision of the detection of the air/fuel ratio low. This necessarily causes a degradation of the precision of the air/fuel ratio control.

In view of the above, there has been provided a system providing an additional air/fuel ratio sensor downstream of the emission control catalyst device, for performing an air/fuel ratio feedback control using two air/fuel ratio sensors. (see Japanese Unexamined Patent Publication No. 58-48756).

Namely, although the downstream side air/fuel ratio sensor has low response characteristics because it is located away from the combustion chamber, it is not significantly influenced by a balance of the exhaust gas components (CO, HC, NOx, $CO_2$ and so forth), and is subject to a lesser amount of corrosive components in the exhaust gas to thus have less possibility of causing variations of the characteristics due to an influence of the corrosive substance, because it is located downstream of the emission control catalytic device. In addition, since the exhaust gas has a good mixing condition, a substantially average air/fuel ratio over all engine cylinders can be detected, to thus demonstrate higher accuracy and a higher stability in a detection of the air/fuel ratio.

Therefore, by combining two air/fuel ratio feedback correction coefficients respectively set based on the detected values of two air/fuel ratio sensors through the same process set forth above, or alternatively, by correcting the control constant (proportional component or integral component) of the air/fuel ratio correction coefficient set by the upstream side air/fuel ratio sensor, or correcting the comparative voltage of the output voltage or delay time of the upstream side air/fuel ratio sensor to compensate for fluctuation of the output characteristics of the upstream side air/fuel ratio sensor by the downstream side air/fuel ratio sensor, is to enable a high precision air/fuel ratio feedback control.

In the air/fuel ratio control system employing two air/fuel ratio sensors, however, it is possible to significantly vary the demand level of air/fuel ratio correction between the active state of the feedback control and inactive state of the feedback control. Particularly, at the transition from the inactive state of feedback control to the active state of feedback control, the following problem can arise at an initiation of the feedback control.

Namely, in the above-mentioned case, the feedback control speed of the downstream side air/fuel ratio sensor is set to be smaller than the feedback control speed of the upstream side air/fuel ratio sensor. That is, since the air/fuel ratio correction by the downstream side air/fuel ratio sensor is for a fine adjustment of a fluctuation of the output characteristics of the air/fuel ratio sensor of the upstream side, it may cause hunting when the feedback speed is large, but by making the feedback speed of the downstream side air/fuel ratio sensor low, it will take a long time to reach the air/fuel ratio correction amount (for example, the correction amount for the proportional component of the air/fuel ratio feedback correction coefficient by the upstream side air/fuel ratio sensor). This results in a degradation of the fuel economy, drivability, and emission control performance.

On the other hand, even during an active state of the air/fuel ratio feedback control, when the driving condition of the engine is transferred to a different range, the air/fuel ratio can be significantly offset from the target air/fuel ratio. Even in this case, the fuel economy, the drivability, and emission control performance can be degraded.

Accordingly, there has been proposed an air/fuel ratio control system in which the typical value of the second air/fuel ratio correction amount on the basis of the downstream side air/fuel ratio sensor is calculated as a learnt correction value from time-to-time and stored with respect to the respective engine driving range, and the fuel supply amount set with a correction using the learnt correction value, to provide stable air/fuel ratio control. (see Japanese Unexamined Patent Publication No. 63-97851).

On the other hand, the second air/fuel ratio correction amount based on the downstream side air/fuel ratio sensor is used to gradually correct the offset of the first air/fuel ratio correction value. Therefore, the control period of the second air/fuel ratio correction value is set to be long because a shorter control period may result in a large overshoot of the air/fuel ratio. Accordingly, when the engine driving ranges for storing the learnt correction value are divided into relatively small ranges, the period of a respective driving range becomes short. Since the control period is relatively long, learning cannot be progressed effectively.

On the other hand, the demand value of the learnt correction value is significantly differentiated depending upon the driving conditions (active or inactive states of EGR and so forth) and the basic value of the proportional component (in the case of a vehicle with a manual transmission, the proportional component for a certain driving range is set particularly small in order to avoid surge). Therefore, excessively large driving ranges for storing the learnt correction values may cause a degradation of the learning accuracy.

Accordingly, conventionally, it has been attempted to establish a balance of a quick progress of learning and an accuracy of learning to set the size of the driving ranges to store the learnt correction values, but a difficulty is encountered in satisfying both, thus causing a degradation of the exhaust emission characteristics or a degradation of the drivability due to fluctuations of the air/fuel ratio.

The present invention is intended to solve these problems in the prior art. Therefore, an object of the present invention is to satisfy both a promotion of learning and an improvement of the accuracy of learning by varying the learning speed of the learnt correction value, i.e., the modification ratio per respective learning cycle, depending upon a degree of progress of the learning.

Another object of the present invention is to provide high efficiency of reduction of emission levels of CO, HC, NOx and so forth by appropriately controlling the air/fuel ratio instantly in response to a variation of the driving range.

A further object of the invention is to maintain a proper control of the air/fuel ratio over a long period, in order to maintain a high efficiency of the reduction of the emission level.

A still further object of the invention is to restrict a difference of a degree of progress of learning between driving ranges by employing unified learning reflecting a part of a result of a learning with respect to each driving range for an overall driving range, for promoting a learning in all driving ranges.

A further object of the invention is to further promote a learning and improve an accuracy of a learning by varying the modification rate of the unified learning depending on a degree of progress of the unified learning.

SUMMARY OF THE INVENTION

In order to accomplish the above-mentioned objects, a method and system for controlling an air/fuel ratio control system in an internal combustion engine includes:

a first air/fuel ratio sensor sensitive to a concentration of a specific gas component in an exhaust gas variable depending upon an air/fuel ratio, to vary the output value thereof and being disposed in an exhaust passage of the internal combustion engine, upstream of an emission control catalyst device;

a second air/fuel ratio sensor sensitive to a concentration of the specific gas component in the exhaust gas variable depending upon the air/fuel ratio, to vary the output value, and being disposed in the exhaust passage downstream of the emission control catalyst device;

first air/fuel ratio correction amount calculation means or step for calculating a first air/fuel ratio correction amount depending upon the output value of the first air/fuel ratio sensor;

second air/fuel ratio correction amount calculation means or step for calculating a second air/fuel ratio correction amount depending upon the output value of the second air/fuel ratio sensor;

air/fuel ratio correction amount calculation means or step for calculating a final air/fuel ratio correction amount on the basis of the first air/fuel ratio correction amount and the second air/fuel ratio correction amount;

air/fuel ratio feedback control means or step for feedback controlling the air/fuel ratio toward a target air/fuel ratio on the basis of the final air/fuel ratio correction amount;

area-dependent learnt correction value storing means or step for re-writably storing area-dependent learnt correction values for correcting the second air/fuel ratio correction amount with respect to a plurality of divided driving ranges;

area-dependent learnt correction value modification means or step for re-writing the area-dependent learnt correction value of the corresponding driving range stored in the area-dependent learnt correction value storing means or step with a value modified on the basis of the output of the second air/fuel ratio sensor;

wherein the system further includes:

area-dependent learning progress degree storing means or step for measuring and storing a degree of progress of learning of the area-dependent learnt correction value with respect to each driving range of the area-dependent learnt correction value storing means or step;

area-dependent learnt correction value modification ratio setting means or step for setting a modification ratio for each learning of the area-dependent learnt correction value by the area-dependent learnt correction value modifying means or step, depending upon a degree of progress of learning storing with respect to each driving range in the area-dependent learning progress degree storing means or step.

With this construction, the first air/fuel ratio correction amount setting step or means sets the first air/fuel ratio correction amount on the basis of the detected value of the first air/fuel ratio sensor.

On the other hand, the area-dependent learnt correction value modification step or means modifies and re-writes the area-dependent learnt correction value of the corresponding driving range stored in the area-dependent learnt correction value storing step or means, and on the basis of the output of the second air/fuel ratio sensor.

At this time, the modification amount is set based on the modification ratio set by the area-dependent learnt correction value modification ratio setting step or means depending upon the degree of progress of learning stored in the area-dependent learning progress degree storing step or means.

The second air/fuel ratio correction calculation step or means calculates the second air/fuel ratio correction amount on the basis of the output from the second air/fuel ratio sensor and the area-dependent learnt correction value; and, based on the first air/fuel ratio correction amount and the second air/fuel ratio correction amount, the final air/fuel ratio correction amount is calculated by the air/fuel ratio correction amount calculation step or means.

Thus, by setting the modification ratio for each learning of the area-depend learnt correction value depending upon the degree of progress of learning, learning can be promoted by setting the modification ratio at a large value at the initial stage where the degree of progress of learning is low, and an accuracy of learning can be enhanced by setting the modification ratio small at the later stage where the learning is sufficiently progressed.

On the other hand, the above-mentioned air/fuel ratio control method or system may further include:

unified learnt correction value storing means or step for re-writably storing a unified learnt correction value for uniformly correcting the second air/fuel ratio correction value over all driving ranges;

unified learnt correction value modification means or step for re-writing the unified learnt correction value stored in the unified learnt correction value storing means or step with a modified value derived by adding an averaged value of the area-dependent learnt correction values;

second area dependent learnt correction value modification means or step for modifying and re-writing the area-dependent learnt correction values of all driving ranges stored in the area-dependent learnt correction value storing means or step by subtracting the correction amount added in the unified learnt correction value modifying means or step.

Therefore, by the unified learnt correction value modification step or means, the unified learnt correction value stored in the unified correction value storing step or means can be modified and re-written with a value derived by adding the average value of the area-dependent learnt correction value. At the same time, upon learning of the unified learnt correction value, the area-dependent learnt correction values of all of the driving ranges stored in the area-dependent learnt correction value storing step or means are modified and re-written by subtracting a modification amount corresponding to a modification amount for the unified learnt correction value.

Learning performed by matching such a unified learning over a wide driving range and the area-dependent learning with respect to each of the divided driving ranges is used in combination with the area-dependent learning depending upon a degree of progress of learning, and both a promotion of learning and an enhancement of the accuracy of the learning can be achieved.

On the other hand, in the system using the unified learnt correction value storing step or means, the unified learnt correction value modification step or means and the second area-dependent learnt correction value modification step or means, in place of the area-dependent learning progress degree storing means or step and the area-dependent learnt correction value modification ratio setting means or step, or in combination therewith, the method further includes:

unified learning progress degree storing means or step for measuring and storing a degree of progress of learning by the unified learnt correction value storing means or step, unified learnt correction value modification ratio setting means or step for setting a modification ratio of the unified learnt correction value by the unified learnt correction value modifying means or step depending upon the degree of progress of learning stored in the unified learning progress degree storing means or step.

As set forth above, when setting the modification ratio depending upon the degree of progress of learning with respect to the unified learning in place of setting of the modification ratio depending upon degree of progress of learning of the area-dependent learning, a similar effect of a promotion of learning and an enhancement of the accuracy of learning can be obtained.

On the other hand, it is possible to provide the area-dependent learning progress degree storing step or means and the area-dependent learnt correction value modification ratio setting step or means, and in addition thereto, to provide the unified learning progress degree storing step or means and the unified learnt correction value modification ratio setting step or means.

Therefore, by setting the modification ratios for both the area-dependent learning and the unified learning, a further effect of promoting learning and an enhancement of learning can be obtained.

DESCRIPTION OF THE PREFERRED EMBODIMENT

Figure 1:
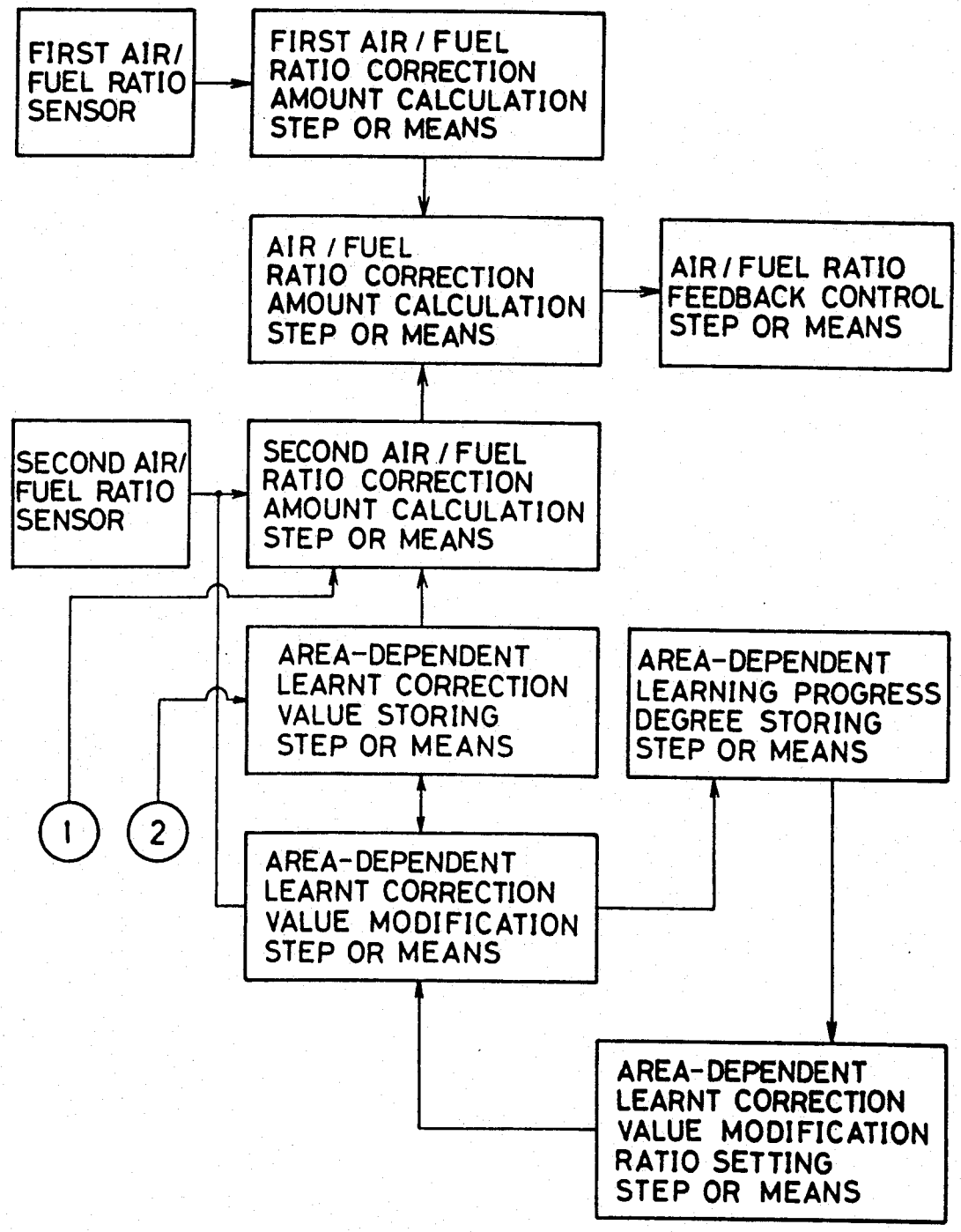
FIGS. 1(A) and 1(B) are block diagrams showing the construction and function of the present invention.
Figure 1:
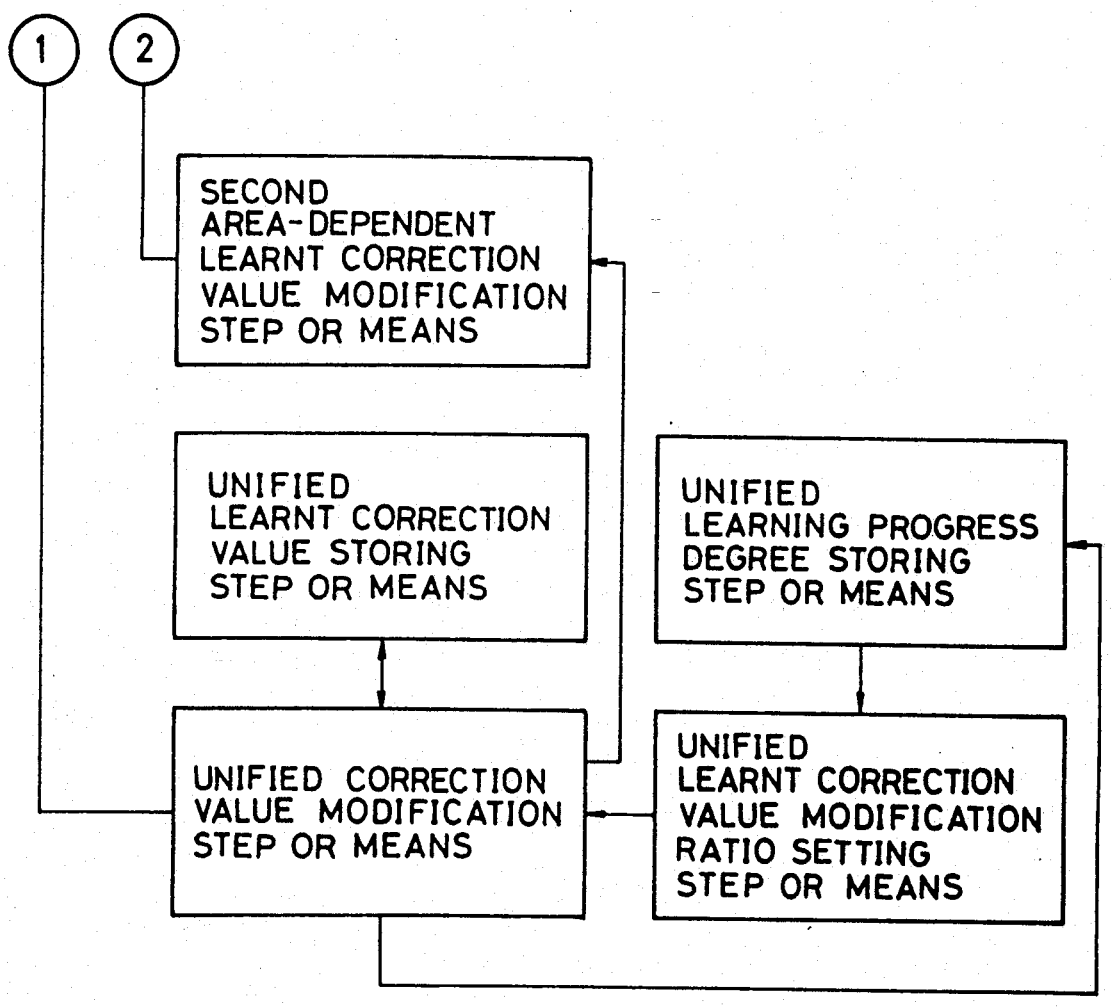

The above-mentioned air/fuel ratio control system for an internal combustion engine according to the present invention comprises respective steps or means illustrated in FIGS. 1(A) and 1(B). The construction and operation of the preferred embodiment of the air/fuel ratio control system for the internal combustion engine is illustrated in FIGS. 2 to 7.

Figure 2:
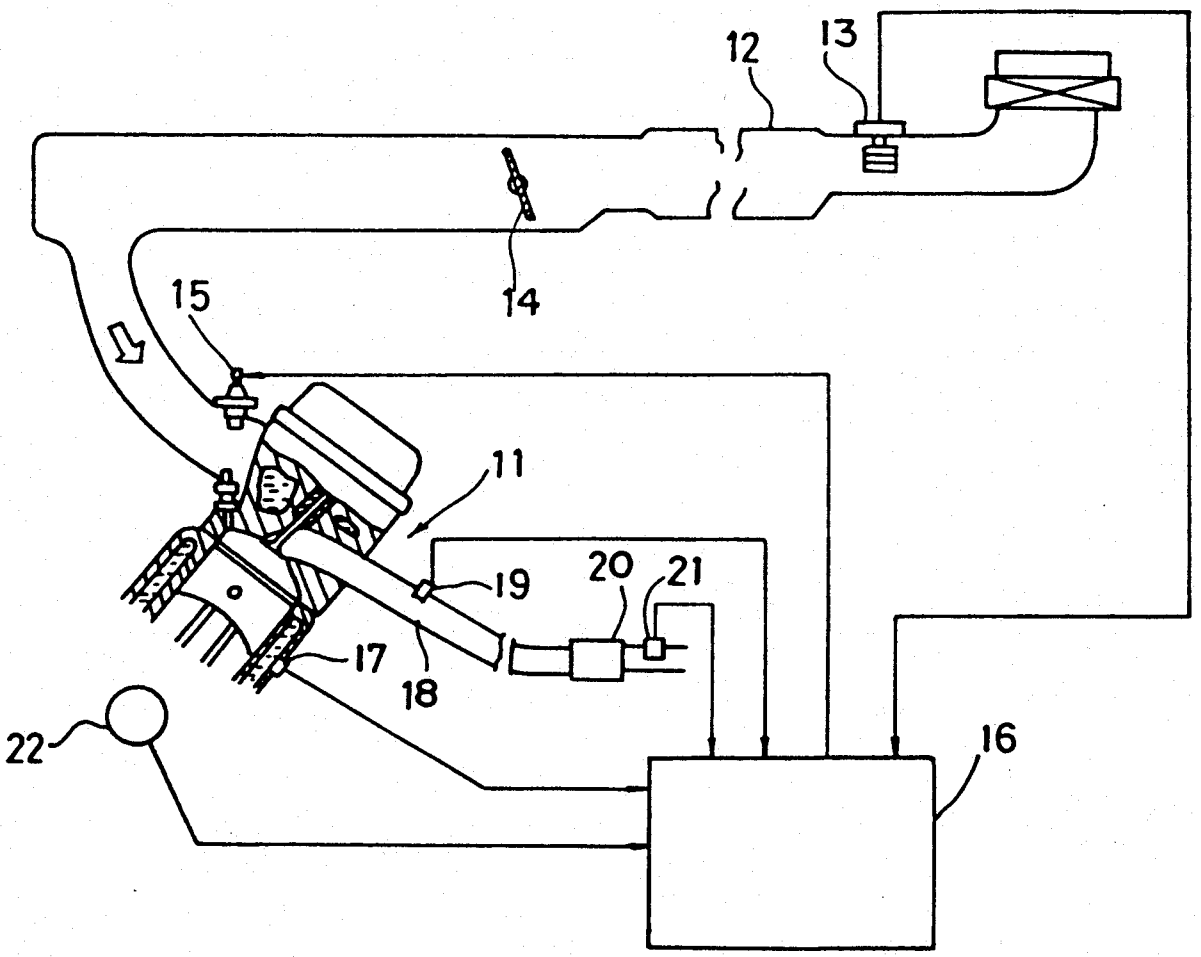
FIG. 2 is a diagrammatic illustration of one embodiment of the present invention.

In FIG. 2, illustrating the construction of one embodiment of the invention, an air flow meter 13 for detecting an intake air flow rate Q and a throttle valve 14 linked with an accelerator pedal for controlling the intake air flow rate Q are provided in an induction passage 12 of an internal combustion engine 11, and electromagnetic fuel injection valves 15 for respective engine cylinders are provided in the downstream portion of an intake manifold.

The fuel injection valve 15 is designed to be opened by an injection pulse signal from a control unit 16 incorporating a microcomputer, to inject fuel pressurized by a fuel pump (not shown) and controlled at a given pressure by a pressure regulator. Furthermore, an engine coolant temperature sensor 17 is provided in a water jacket of the engine 11 for detecting an engine coolant temperature Tw. On the other hand, a first air/fuel ratio sensor 19 is disposed in a converging section of a manifold in an exhaust passage 18 for detecting an oxygen concentration in an exhaust gas, to thus detect an air/fuel ratio of an air/fuel mixture burnt in the combustion chamber of the engine. A catalytic converter 20 as an emission control catalyst device is provided in the exhaust passage downstream of the first air/fuel ratio sensor 19, for oxidation of CO and HC and reduction of NOx in the exhaust gas. A second air/fuel ratio sensor 21 having the same function as the first air/fuel ratio sensor is provided further downstream of the catalytic converter 20.

In a distributor, not shown in FIG. 2, a crank angle sensor 22 is housed, and an engine speed N is derived by counting crank angle signals of the crank angle sensor 22 over a given period, or by measuring a period of crank reference signals, which crank angle signal and crank reference signals are generated in synchronism with the engine revolution.

Figure 3:
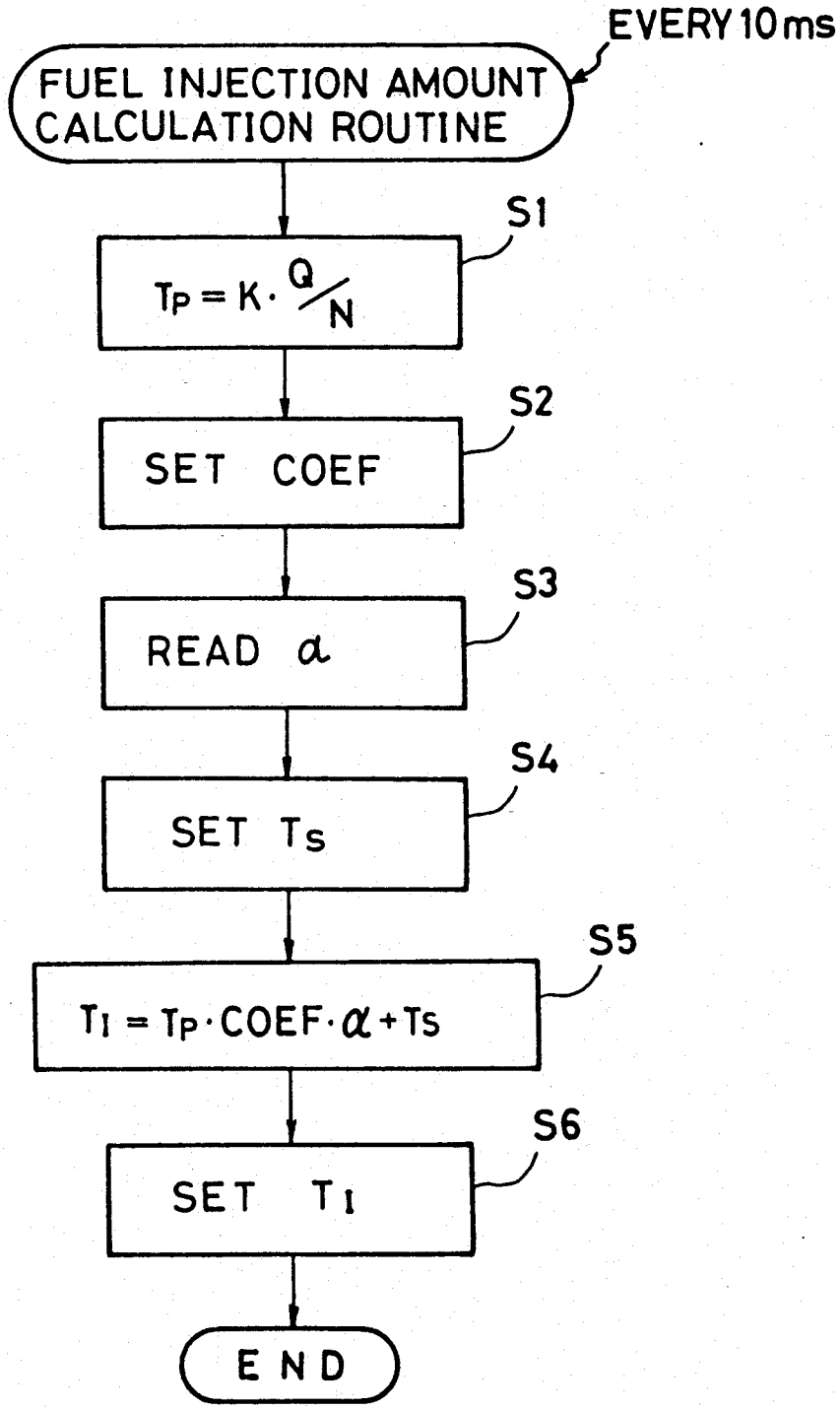
FIG. 3 is a flow chart showing a routine for setting a fuel injection amount in the above-mentioned embodiment.
Figure 4:
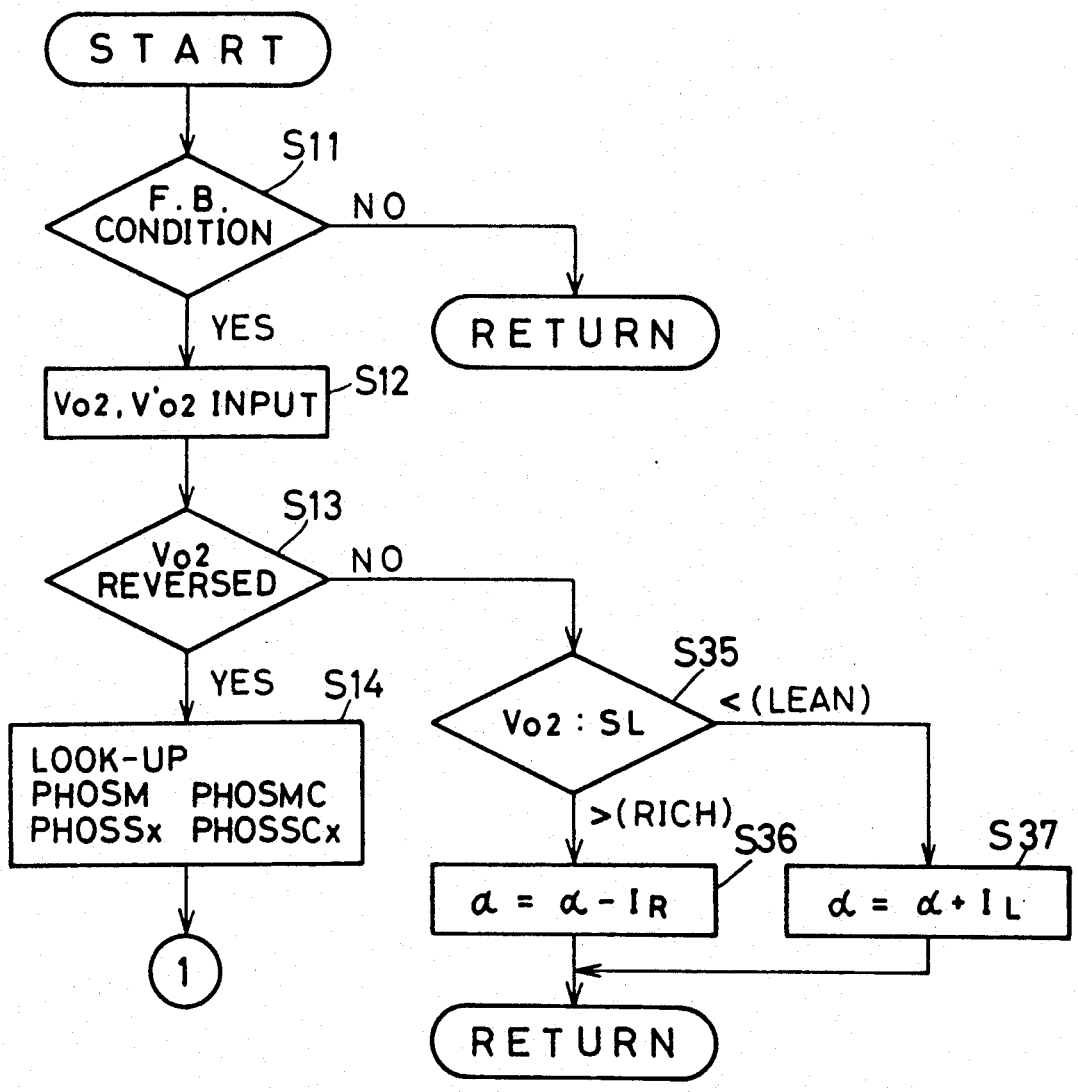
FIGS. 4(A), 4(B) and 4(C) are flow charts showing a routine for setting an air/fuel ratio feedback correction coefficient.
Figure 4:
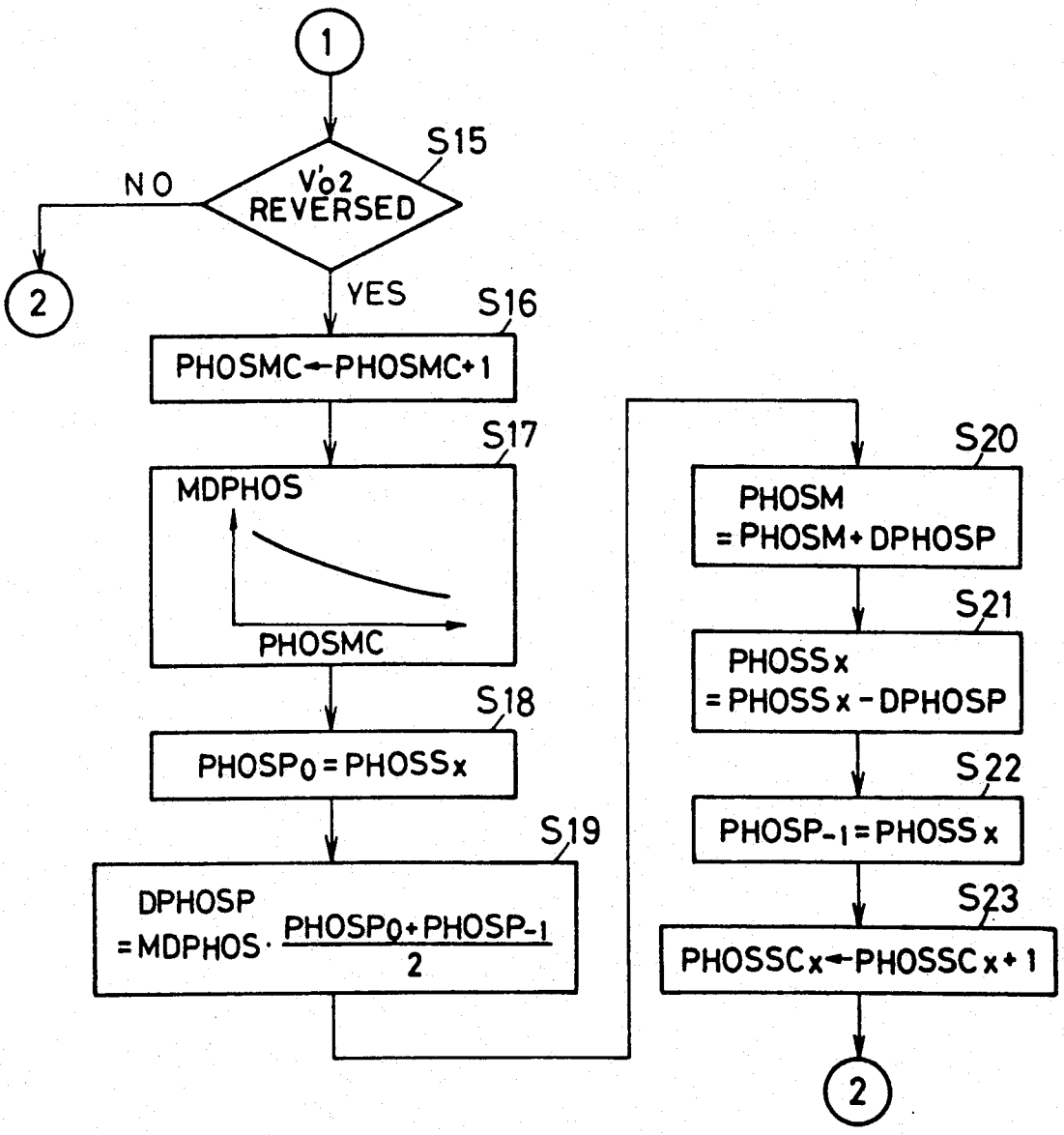
Figure 4:
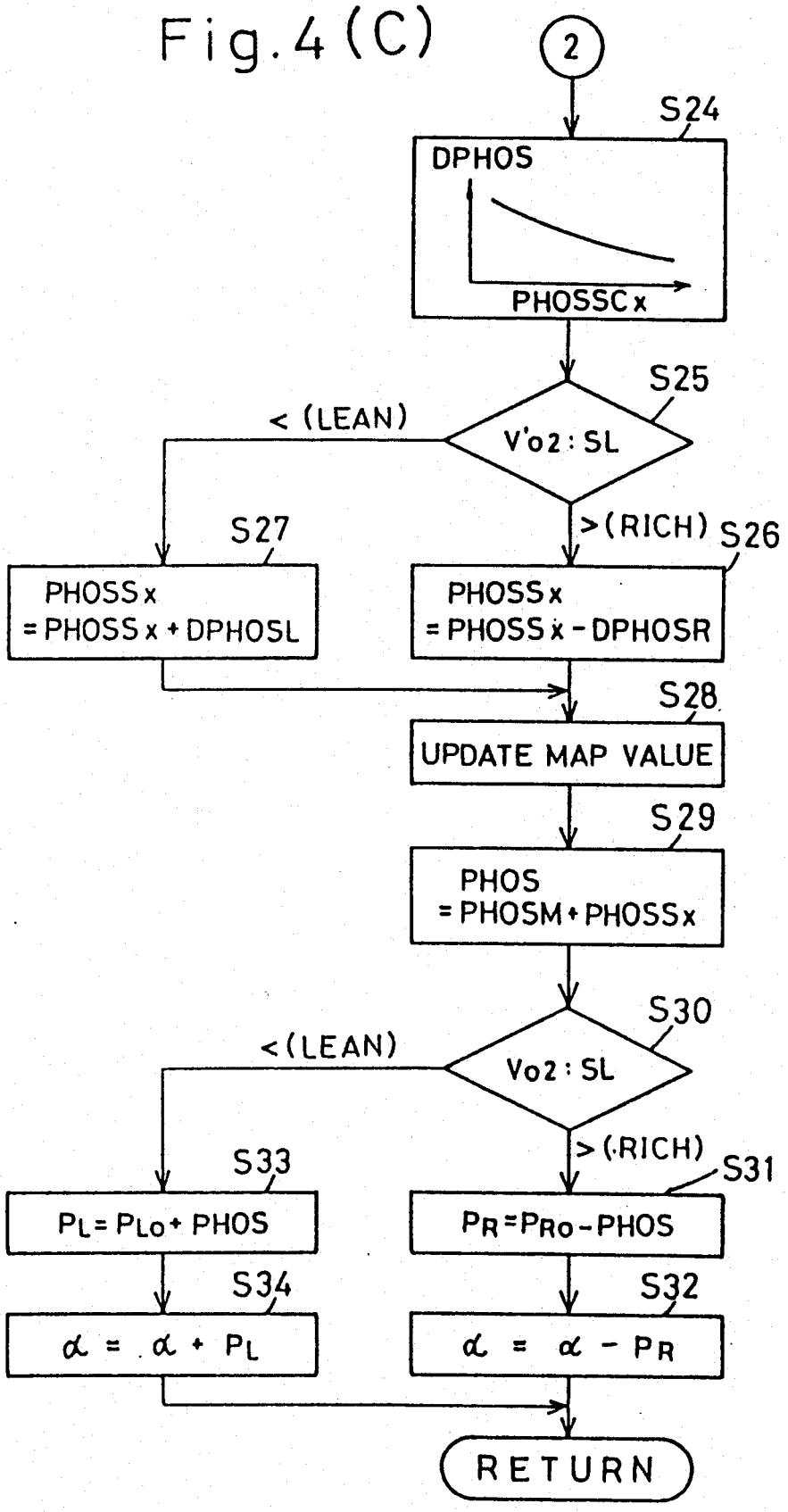
Figure 5:
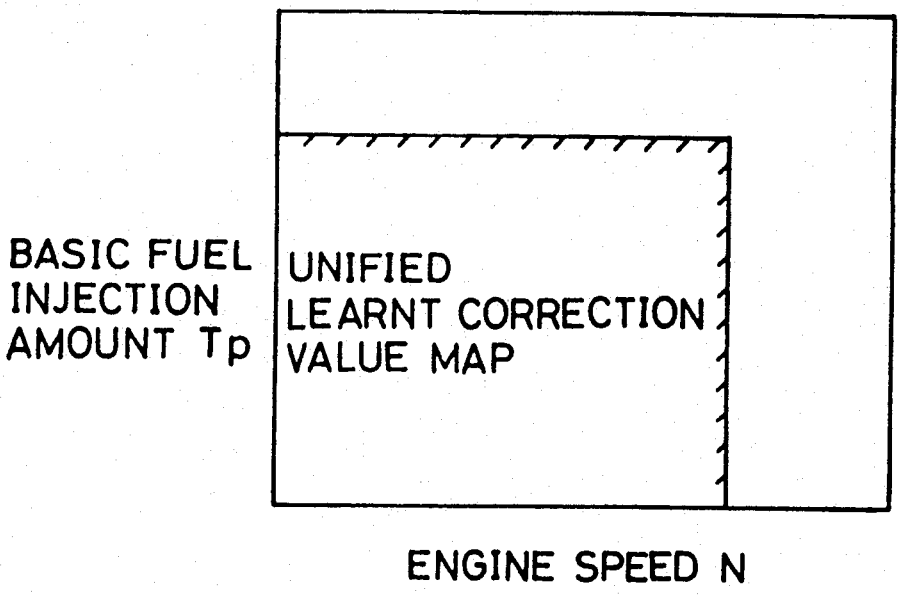
FIGS. 5(A), 5(B) and 5(C) are illustrations of a map re-writably storing a unified learnt correction coefficient, an area-dependent learnt correction value, and an area-dependent learning progressing degree respectively, during an active state of air/fuel ratio feedback control in the above-mentioned embodiment.
Figure 5:
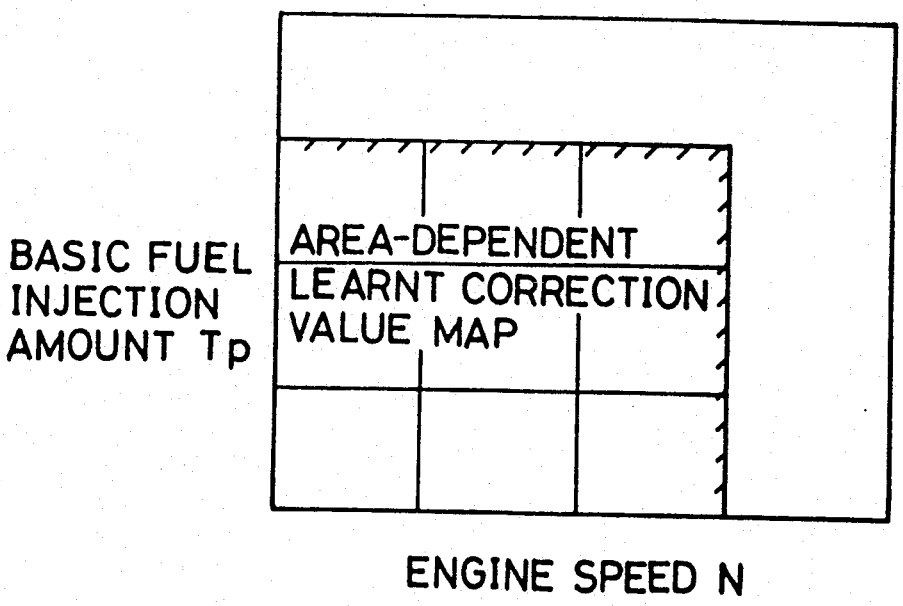
Figure 5:
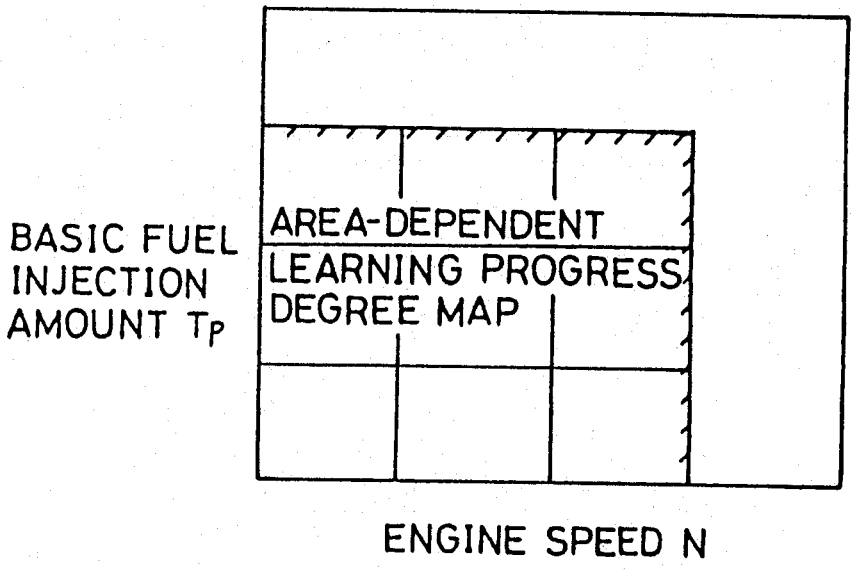

Next, an air/fuel ratio control routine to be executed by the control unit 16 will be discussed with reference to FIGS. 2 and 3. FIG. 3 shows a fuel injection amount setting routine periodically executed at given intervals (for example, 10 ms).

At step (labeled S in the drawing) 1, based on the intake air flow rate Q detected by the air flow meter 13 and the engine speed N derived on the basis of the signal from the crank angle sensor 22, a basic fuel injection amount Tp, which corresponds to an intake air flow rate at a unit angle of engine revolution, is calculated through the following equation:

$$Tp = K \times Q/N \quad (K \text{ is constant})$$

At step 2, various correction coefficients COEF based on the engine coolant temperature Tw detected by the engine coolant temperature sensor 17 and so forth, are set.

At step 3, an air/fuel ratio feedback correction coefficient $\alpha$ set through the later-mentioned air/fuel ratio feedback correction coefficient setting routine, is read out.

At step 4, a battery voltage dependent correction value Ts is set on the basis of a battery voltage. This is for correcting variation of the injection flow rate of the fuel injection valve 15 depending upon fluctuation of the battery voltage.

At step 5, a final fuel injection amount (fuel supply amount Tl) is calculated through the following equation.

$$Tl = Tp \times \mathrm{COEF} X\alpha + Ts$$

At step 6, the calculated fuel injection amount Tl is set in an output register.

Accordingly, at a predetermined fuel injection timing set in synchronism with the engine revolution, a drive pulse signal having a pulse width corresponding to the calculated fuel injection amount Tl is applied to the fuel injection valve 15, to perform a fuel injection.

Through the process set forth above, by setting the fuel supply amount using the air/fuel ratio feedback correction coefficient $\alpha$ read out at the step 3, the above-mentioned routine for a control of the air/fuel ratio toward a target air/fuel ratio forms an air/fuel ratio feedback control or means.

Next, the air/fuel ratio feedback correction coefficient setting routine will be discussed with reference to FIGS. 4(A)–4(C).

At step 11, it is determined whether the engine driving condition satisfies a given condition for effecting a feedback control of the air/fuel ratio. The above-mentioned given condition is the same as the condition for performing a learning of a unified learnt correction value PHOSM and an area-dependent learnt correction value $PHOSS_x$. It should be noted that the learning may be done by taking the steady condition into account, for further improving the accuracy. When the engine driving condition does not satisfy the given condition, the shown process is ended. In this case, the air/fuel ratio feedback correction coefficient $\alpha$ is clamped at a value corresponding to the value at termination of the air/fuel ratio control in the preceding cycle or at a given reference value, and the air/fuel ratio feedback control is terminated.

At step 12, a signal voltage $V_{02}$ from the first air/fuel ratio sensor 19 and signal voltage $V'_{02}$ of the second air/fuel ratio sensor 21 are input.

At step 13, the signal voltage $V_{02}$ from the first air/fuel ratio sensor 19 input at the step 12 is compared with a reference value SL corresponding to a target air/fuel ratio (stoichiometric air/fuel ratio) to determine whether the air/fuel ratio is reversed from lean to rich or from rich to lean.

When a reversal is found, the process is advanced to step 14 in which, in order to make a learning correction for the second air/fuel ratio correction value as the proportional correction component PHOS of the air/fuel ratio feedback correction coefficient $\alpha$, a map lookup is performed against a unified learnt correction value map (stored in RAM of the microcomputer incorporated in the control unit 16) which stores the unified learnt correction coefficient PHOSM. Also, a learning degree indicative counter value PHOSMC for the unified learned correction value resulting from counting every occurrence of a reversal of output of the second air/fuel ratio sensor 21, is read out. Furthermore, on the basis of the engine speed N and the basic fuel injection amount Tp, a map look-up is performed for the area-dependent learnt correction value $PHOSS_x$ in the corresponding driving range in an area-dependent learnt correction value map (also stored in RAM) storing the area-dependent learnt correction value of the proportional correction component PHOS. In addition, from an area-dependent learning progress degree map a storing count derived by counting every occurrence of a reversal of output of the second air/fuel ratio sensor 21, a learning progress degree $P_{HOSSCx}$ of the corresponding driving range x is read out as a representation of the learning progress degree of the area-dependent learnt correction value.

It should be noted that, as shown in FIGS. 5(A)–5(C), in the unified learnt correction map one unified learnt correction value $P_{HOSM}$ is stored for all driving ranges, to perform a learning. In the area-dependent learnt correction value map, respective area-dependent learnt correction values are stored in nine respective driving ranges defined by dividing the ranges of the engine speed N and the basic fuel injection amount Tp, respectively, into three ranges each. In the area-dependent learning progress degree map, the learning progress degree of the area-dependent learnt correction value for respective driving ranges is divided in a manner similar to the area-dependent learnt correction values.

The RAM's storing of the unified learnt correction value $P_{HOSM}$ and the area-dependent learnt correction value $P_{HOSSx}$, from a unified learnt correction value storing step or means and the area-dependent learnt correction value storing step or means.

At step 15, the signal voltage V'02 of the second air/fuel ratio sensor 21 is compared with the reference value SL corresponding to the target air/fuel ratio (stoichiometric air/fuel ratio) to determine whether the air/fuel ratio is just reversed from lean to rich or from rich to lean.

If reversal is found, the process is progressed to step 16 to count up and update the unified learning progress degree $P_{HOSMC}$. Namely, by the function of step 16 and the RAM's storing of the unified learning process degree $P_{HOSMC}$, a unified learning progress degree storing step or means is obtained.

At step 17, depending upon the unified learning progress degree $P_{HOSMC}$ updated at step 16, a map look-up is performed for a modification ratio MDPHOS for the unified learnt correction value using a unified learnt correction value modification ratio map stored in ROM. Namely, the function of step 17 and the ROM's storing of the modification ratio MDPHOS of the unified learnt correction value form a unified learnt correction value modification ratio setting step or means.

At step 18, the area-dependent learnt correction value $P_{HOSSx}$ derived at step 14 is set as a current value $P_{HOSP0}$.

At step 19, a modification amount DPHOSP of the unified learnt correction value $P_{HOSM}$ is calculated through the following equation:

$$DPHOSP = MDPHOS\ (P_{HOSP0} + P_{HOSP-1})/2$$

where, $P_{HOSP-1}$ is the area-dependent correction value $P_{HOSSx}$ at the immediately preceding occurrence of a reversal of the output V'02 of the second air/fuel ratio sensor, and M is a positive constant (<1). Namely, the modification amount DPHOSP is set as a given ratio component of an averaged value of the area-dependent learnt correction value $P_{HOSSx}$ at every occurrence of reversal of the second air/fuel ratio sensor output.

At step 20, the unified learnt correction value $P_{HOSM}$ is modified by adding the modification amount DPHOSP calculated at step 19 to the unified learnt correction value PHOSM derived at step 14, and the unified learnt correction value $P_{HOSM}$ stored in the RAM is updated with the modified value. Namely, the function of step 20 forms the unified correction value modification step or means.

Next, at step 21, the area-dependent learnt correction values $P_{HOSSx}$ of driving ranges in the area-dependent learnt correction value map are modified and re-written by values derived by subtracting the modification amount DPHOSP from the respective stored values. Namely, the function of step 21 forms the second area-dependent learnt correction value modification step or means.

At step 22, the area-dependent correction value $P_{HOSSx}$ calculated at step 21 is set as $P_{HOSP-1}$ for a calculation at step 19 in the next cycle.

At step 23, the area-dependent learning progress degree $P_{HOSSCx}$ of the corresponding driving range is counted up to update the progress degree $P_{HOSSCx}$ of the corresponding driving range in the area-dependent learning map. Namely, the function of step 23 and the RAM's storing of the area-dependent learning progress degree $P_{HOSSCx}$ form an area-dependent learning progress degree storing step or means.

When it is determined that a reversal is not occurring at step 15, the process jumps to step 24, and skips steps 16 to 23.

At step 24, depending upon the area-dependent learning progress degree updated at step 23, a map look-up is performed for an area-dependent learning correction value modification ratio DPHOS using an area-dependent learning progress degree map stored in the ROM. Namely, the function of step 24 and the ROM's storing of the modification ratio DPHOS of the area-dependent correction value form an area-dependent learnt correction value modification ratio setting step or means.

At step 25, by comparing the output V'02 of the second air/fuel ratio sensor with the reference value SL, it is determined whether the air/fuel ratio is rich or lean.

If it is determined that the air/fuel ratio is rich (V'02>SL), the process is advanced at step 26, in which the area-dependent correction value $P_{HOSSx}$ is modified by subtracting the given value DPHOSR from the area-dependent correction value $P_{HOSSx}$ derived at the step 14.

On the other hand, when it is determined that the air/fuel ratio is lean (V'02<SL), the process is advanced to step 27, in which the area-dependent learnt correction value $P_{HOSSx}$ is modified by adding the given value DPHOSL to the derived area-dependent learnt correction value $P_{HOSSx}$.

At step 28, with the area-dependent learnt correction value $P_{HOSSx}$ as modified through step 26 or 27, the area-dependent learnt correction value $P_{HOSSx}$ stored in the corresponding driving range of the area-dependent learnt correction value map is re-written for updating. Namely, the functions of steps 26, 27 and 28 form the area-dependent learnt correction value modification step or means.

At step 29, by adding the unified learnt correction value $P_{HOSM}$ and the area-dependent learnt correction value $P_{HOSS_x}$, updated through the process set forth above, the proportional correction amount $P_{HOS}$ as the second air/fuel ratio correction amount is calculated. Namely, the functions of step 25 and 29 form a second air/fuel ratio correction amount calculation step or means.

Then, the process is advanced to step 30, and it is determined if a rich or lean output is made by the first air/fuel ratio sensor. At the occurrence of a reversal from lean to rich, the process is advanced to step 31, in which a reducing proportional component $P_R$ to be given at a rich reversal, for setting the air/fuel ratio feedback correction coefficient $\alpha$, is updated with a value derived by subtracting the second air/fuel ratio correction amount $P_{HOS}$ from a reference value $P_R0$. Then, at step 32, the air/fuel ratio feedback correction coefficient $\alpha$ is updated with a value derived by subtracting the proportional component $P_R$ from the current value.

On the other hand, at the occurrence of a reversal from rich to lean, the process is advanced to step 33, in which an increasing proportional component PL to be given at a lean reversal, for setting the air/fuel ratio feedback correction coefficient $\alpha$, is updated with a value derived by adding the second air/fuel ratio correction amount $P_{HOS}$ to a reference value $P_L0$. Then, at step 34, the air/fuel ratio feedback correction coefficient $\alpha$ is updated with a value derived by adding the proportional component $P_L$ to the current value.

On the other hand, when it is determined that the output of the first air/fuel ratio sensor is not reversing at step 13, the process is advanced to step 35 to determine a rich or lean state. When a rich determination is made, the process is advanced to step 36, in which the air/fuel ratio feedback correction coefficient $\alpha$ is updated with a value derived by subtracting an integral component $I_R$ from the current value. On the other hand, when a lean determination is made, the process is advanced to step 37 to update the air/fuel ratio feedback correction coefficient $\alpha$ with a value derived by adding an integral component $I_L$ to the current value.

Here, through steps 30 to 37, excluding steps 31 and 33 for correction, the function of setting the air/fuel ratio feedback correction coefficient $\alpha$ forms a first air/fuel ratio correction amount calculation step or means with the first air/fuel ratio sensor 19.

With the construction as set forth above, corrections of the area-dependent learnt correction value and the unified learnt correction value are performed using correction ratios depending upon the degree of progress of learning, and thus it becomes possible to set a large modification ratio to thereby promote the learning while the degree of progress of learning is low. On the other hand, after the learning is sufficiently progressed, the modification ratio is made smaller to increase the accuracy of learning. Therefore, according to the shown construction, both a promotion of learning and an improvement of accuracy of the learning can be achieved. Also, by maintaining a high performance of the air/fuel ratio feedback control, a high emission control performance for CO, HC, NOx and so forth can be maintained for a long period.

In the shown embodiment, it should be appreciated that, since both the area-dependent learnt correction value and the unified learnt correction value are learnt depending upon the degree of progress of learning, the performance can be gradually enhanced, but even when a learning is performed only in the area-dependent learnt correction value and a learning of the area-dependent correction value is performed depending upon the degree of progress of learning, without setting the unified learnt correction value, a sufficiently high performance can be obtained. Also, by performing a learning of only the unified learnt correction value with a modification ratio depending upon the degree of progress of learning, a sufficient effect can be obtained.

Figure 6:
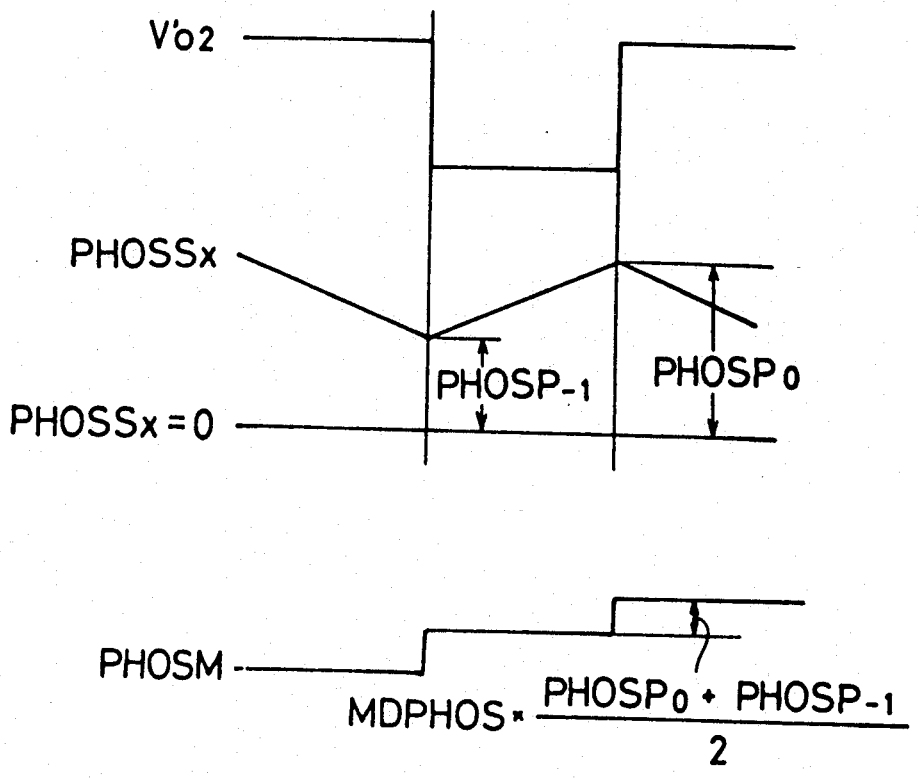
FIG. 6 is a timing chart showing an updating of the unified learnt correction coefficient during an active state of the air/fuel ratio control in the above-mentioned embodiment.
Figure 7:
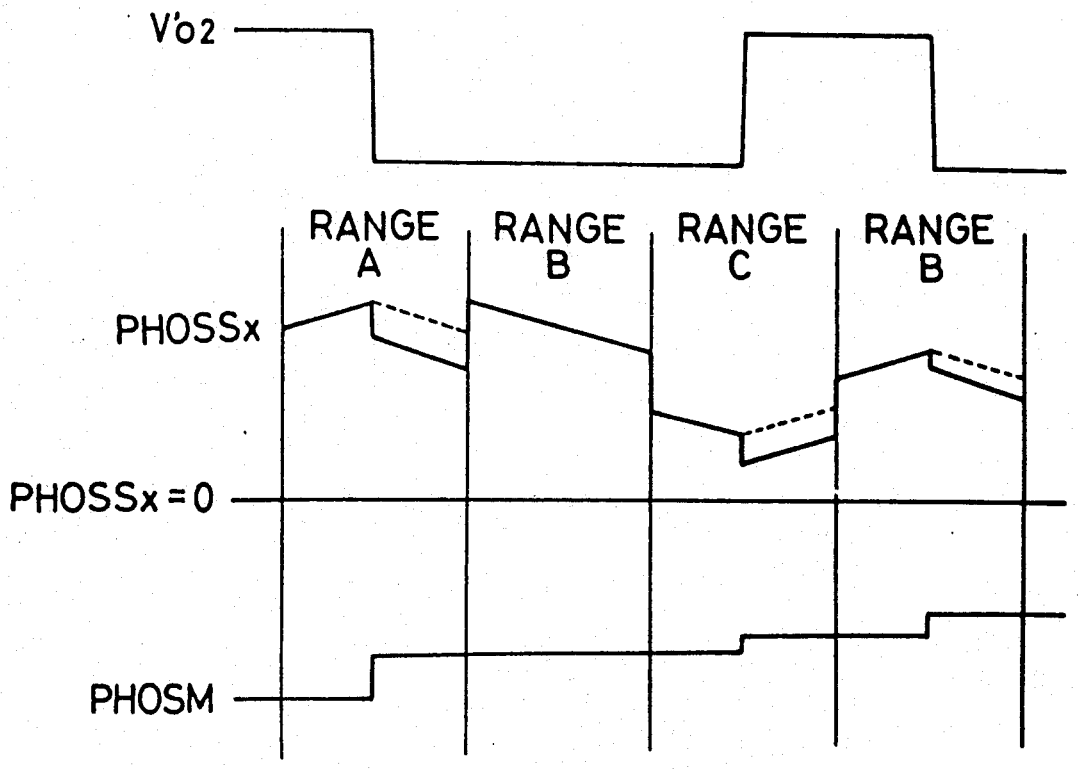
FIG. 7 is a timing chart showing an updating of the area-dependent learnt correction value.

FIGS. 6 and 7 respectively show the process in which the unified learnt correction value $P_{HOSM}$ and the area-dependent correction value $P_{HOSS_x}$ are updated.

INDUSTRIAL APPLICABILITY

As set forth above, the air/fuel ratio control system for the internal combustion engine, according to the present invention, enhances the performance of the air/fuel ratio feedback control, and exhibits a high emission control performance when applied to an internal combustion engine of an automotive vehicle. Therefore, the present invention contributes to the protection of the environment.

What is claimed is:

1. A method of controlling an air/fuel ratio in an internal combustion engine, comprising the steps of:

providing a first air/fuel ratio sensor for sensing a concentration of a specific gas component in an exhaust gas and outputting a first output value, the specific gas component being varied in accordance with the air/fuel ratio to vary the first output value thereof, said first air/fuel ratio sensor being provided in an exhaust passage of the internal combustion engine, upstream of an emission control catalyst device, and a second air/fuel ratio sensor for sensing a concentration of the specific gas component in the exhaust gas and outputting a second output value, the specific gas component being varied in accordance with the air/fuel ratio to vary the second output value, said second air/fuel ratio sensor being provided in the exhaust passage downstream of said emission control catalyst device;

a first air/fuel ratio correction amount calculation step for calculating a first air/fuel ratio correction amount depending upon the first output value of said first air/fuel ratio sensor;

a second air/fuel ratio correction amount calculation step for calculating a second air/fuel ratio correction amount depending upon the second output value of said second air/fuel ratio sensor;

an air/fuel ratio correction amount calculation step for calculating a final air/fuel ratio correction amount on the basis of said first air/fuel ratio correction amount and said second air/fuel ratio correction amount;

an air/fuel ratio feedback control step for a feedback control of the air/fuel ratio toward a target air/fuel ratio on the basis of said final air/fuel ratio correction amount;

an area-dependent learnt correction value storing step for re-writably storing area-dependent learnt correction values for correcting said second air/fuel ratio correction amount with respect to a plurality of divided driving ranges; and an area-dependent learnt correction value modification step for re-writing said area-dependent learnt correction values of corresponding driving ranges stored in said area-dependent learnt correction value storing step with values modified on the basis of the output of said second air/fuel ratio sensor;

wherein the method further comprises the steps of:

an area-dependent learning progress degree storing step for measuring and storing a degree of progress of a learning of the area-dependent learnt correction value with respect to each of said driving ranges of said area-dependent learnt correction value storing step; and an area-dependent learnt correction value modification ratio setting step for setting a modification ratio for each learning of said area-dependent learnt correction values in said area-dependent learnt correction value modifying step, depending upon a degree of progress of a learning, and storing same with respect to each driving range in said area-dependent learning progress degree storing step.

2. A method of controlling an air/fuel ratio in an internal combustion engine as set forth in claim 1, which further comprises the steps of:

a unified learnt correction value storing step for re-writably storing a unified learnt correction value for uniformly correcting said second air/fuel ratio correction value over all driving ranges;

a unified learnt correction value modification step for re-writing said unified learnt correction value stored in said unified learnt correction value storing step with a modified value derived by adding an averaged value of said area-dependent learnt correction values;

a second area dependent learnt correction value modification step for modifying and re-writing said area-dependent learnt correction values of all driving ranges stored in said area-dependent learnt correction value storing step by subtracting the averaged value amount added in said unified learnt correction value modifying step.

3. A method of controlling air/fuel ratio in an internal combustion engine as set forth in claim 2, wherein the method for further comprises the steps of:

a unified learning progress degree storing step for measuring and storing a degree of progress of a learning of said unified learnt correction value storing step, and a unified learnt correction value modification ratio setting step for setting a modification ratio of said unified learnt correction value in said unified learnt correction value modifying step depending upon the degree of progress of learning stored in said unified learning progress degree storing step.

4. An air/fuel ratio control system for an internal combustion engine comprising:

a first air/fuel ratio sensor for sensing a concentration of a specific gas component in an exhaust gas and outputting a first output value, the specific gas component being varied in accordance with the air/fuel ratio to vary the first output value thereof, said first air/fuel ratio sensor being provided in an exhaust passage of the internal combustion engine, upstream of an emission control catalyst device;

a second air/fuel ratio sensor for sensing a concentration of the specific gas component in the exhaust gas and outputting a second output value, the specific gas component being varied in accordance with the air/fuel ratio to vary the second output value, said second air/fuel ratio sensor being provided in the exhaust passage downstream of said emission control catalyst device;

a first air/fuel ratio correction amount calculation means for calculating a first/air fuel ratio correction amount depending upon the first output value of said first air/fuel ratio sensor;

a second air/fuel ratio correction amount calculation means for calculating a second air/fuel ratio correction amount depending upon the second output value of said second air/fuel ratio sensor;

an air/fuel ratio correction amount calculation means for calculating a final air/fuel ratio correction amount on the basis of said first air/fuel ratio correction amount and said second air/fuel ratio correction amount;

an air/fuel ratio feedback control means for a feedback control of the air/fuel ratio toward a target air/fuel ratio on the basis of said final air/fuel ratio correction amount;

an area-dependent learnt correction value storing means for re-writably storing area-dependent learnt correction values for correcting said second air/fuel ratio correction amount with respect to a plurality of divided driving ranges; and an area-dependent learnt correction value modification means for re-writing said area-dependent learnt correction values of corresponding driving ranges stored in said area dependent learnt correction value storing means with a value modified on the basis of the output of said second air/fuel ratio sensor;

wherein the system further comprises:

an area-dependent learning progress degree storing means for measuring and storing a degree of progress of a learning of the area-dependent learnt correction value with respect to each of said driving ranges of said area-dependent learnt correction value storing means; and an area-dependent learnt correction value modification ratio setting means for setting a modification ratio for each learning of said area-dependent learnt correction values in said area-dependent learnt correction value modifying means, depending upon a degree of progress of a learning, and storing same with respect to each driving range in said area-dependent learning progress degree storing means.

5. An air/fuel ratio control system for an internal combustion engine as set forth in claim 4, which further comprises:

a unified learnt correction value storing means for re-writably storing a unified learnt correction value for uniformly correcting said second air/fuel ratio correction value over all driving ranges;

a unified learnt correction value modification means for re-writing said unified learnt correction value stored in said unified learnt correction value storing means with a modified value derived by adding an averaged value of said area-dependent learnt correction values;

a second area dependent learnt correction value modification means for modifying and re-writing said area-dependent learnt correction values of all driving ranges stored in said area-dependent learnt correction value storing means by subtracting the averaged value added in said unified learnt correction value modifying means.

6. An air/fuel ratio control system for an internal combustion engine as set forth in claim 5, wherein, the system further comprises:

a unified learning progress degree storing means for measuring and storing a degree of progress of a learning of said unified learnt correction value storing means, and a unified learnt correction value modification ratio setting means for setting a modification ratio of said unified learnt correction value in said unified learnt correction value modifying means depending upon the degree of progress of learning stored in said unified learning progress degree storing means.

7. A method of controlling an air/fuel ratio in an internal combustion engine, comprising the steps of:

providing a first air/fuel ratio sensor for sensing a concentration of a specific gas component in an exhaust gas and outputting a first output value, the specific gas component being varied in accordance with the air/fuel ratio to vary the first output value thereof, said first air/fuel ratio sensor being provided in an exhaust passage of the internal combustion engine, upstream of an emission control catalyst device, and a second air/fuel ratio sensor for sensing a concentration of the specific gas component in the exhaust gas and outputting a second output value, the specific gas component being varied in accordance with the air/fuel ratio to vary the second output value, said second air/fuel ratio sensor being provided in the exhaust passage downstream of said emission control catalyst device;

a first air/fuel ratio correction amount calculation step for calculating a first air/fuel ratio correction amount depending upon the first output value of said first air/fuel ratio sensor;

a second air/fuel ratio correction amount calculation step for calculating a second air/fuel ratio correction amount depending upon the second output value of said second air/fuel ratio sensor;

an air/fuel ratio correction amount calculation step for calculating a final air/fuel ratio correction amount on the basis of said first air/fuel ratio correction amount and said second air/fuel ratio correction amount;

an air/fuel ratio feedback control step for a feedback control of the air/fuel ratio toward a target air/fuel ratio on the basis of said final air/fuel ratio correction amount;

an area-dependent learnt correction value storing step for re-writably storing area-dependent learnt correction values for correcting said second air/fuel ratio correction amount with respect to a plurality of divided driving ranges;

an area-dependent learnt correction value modification step for re-writing said area-dependent learnt correction values of corresponding driving ranges stored in said area-dependent learnt correction value storing step with values modified on the basis of the output of said second air/fuel ratio sensor;

a unified learnt correction value storing step for re-writably storing a unified learnt correction value for uniformly correcting said second air/fuel ratio correction value over all driving ranges;

a unified learnt correction value modification step for re-writing said unified learnt correction value stored in said unified learnt correction value storing step with a modified value derived by adding an averaged value of said area-dependent learnt correction values;

a second area dependent learnt correction value modification step for modifying and re-writing said area-dependent learnt correction values of all driving ranges stored in said area-dependent learnt correction value storing step by subtracting the averaged value added in said unified learnt correction value modifying step; and a unified learning progress degree storing step for measuring and storing a degree of progress of a learning of said unified learnt correction value storing step, and a unified learnt correction value modification ratio setting step for setting a modification ratio of said unified learnt correction value in said unified learnt correction value modifying step depending upon the degree of progress of learning stored in said unified learning progress degree storing step.

8. An air/fuel ratio control system for an internal combustion engine comprising:

a first air/fuel ratio sensor for sensing a concentration of a specific gas component in an exhaust gas and outputting a first output value, the specific gas component being varied in accordance with the air/fuel ratio to vary the first output value thereof, said first air/fuel ratio sensor being provided in an exhaust passage of the internal combustion engine, upstream of an emission control catalyst device;

a second air/fuel ratio sensor for sensing a concentration of the specific gas component in the exhaust gas and outputting a second output value, the specific gas component being varied in accordance with the air/fuel ratio to vary the second output value, said second air/fuel ratio sensor being provided in the exhaust passage downstream of said emission control catalyst device;

a first air/fuel ratio correction amount calculation means for calculating a first/air fuel ratio correction amount depending upon the first output value of said first air/fuel ratio sensor;

a second air/fuel ratio correction amount calculation means for calculating a second air/fuel ratio correction amount depending upon the second output value of said second air/fuel ratio sensor;

an air/fuel ratio correction amount calculation means for calculating a final air/fuel ratio correction amount on the basis of said first air/fuel ratio correction amount and said second air/fuel ratio correction amount;

an air/fuel ratio feedback control means for a feedback control of the air/fuel ratio toward a target air/fuel ratio on the basis of said final air/fuel ratio correction amount;

an area-dependent learnt correction value storing means for re-writably storing area-dependent learnt correction values for correcting said second air/fuel ratio correction amount with respect to a plurality of divided driving ranges;

an area-dependent learnt correction value modification means for re-writing said area-dependent learnt correction values of corresponding driving ranges stored in said area dependent learnt correction value storing means with values modified on the basis of the output of said second air/fuel ratio sensor;

a unified learnt correction value storing means for re-writably storing a unified learnt correction value for uniformly correcting said second air/fuel ratio correction value over all driving ranges;

a unified learnt correction value modification means for re-writing said unified learnt correction value stored in said unified learnt correction value storing means with a modified value derived by adding an averaged value of said area-dependent learnt correction values;

a second area dependent learnt correction value modification means for modifying and re-writing said area-dependent learnt correction values of all driving ranges stored in said area-dependent learnt correction value storing means by subtracting the averaged value added in said unified learnt correction value modifying means; and a unified learning progress degree storing means for measuring and storing a degree of progress of a learning of said unified learnt correction value storing means, and a unified learnt correction value modification ratio setting means for setting a modification ratio of said unified learnt correction value in said unified learnt correction value modifying means depending upon the degree of progress of learning stored in said unified learning progress degree storing means.

* * * * *